United States Patent [19]

Carpenter et al.

[11] Patent Number: 4,850,408

[45] Date of Patent: Jul. 25, 1989

[54] CHIPPER KNIFE

[75] Inventors: Charles T. Carpenter; Robert M. Bayly, both of Lake Oswego, Oreg.

[73] Assignee: Commercial Knife, Inc., Lake Oswego, Oreg.

[21] Appl. No.: 211,354

[22] Filed: Jun. 24, 1988

Related U.S. Application Data

[62] Division of Ser. No. 66,864, Jun. 24, 1987, Pat. No. 4,771,718.

[51] Int. Cl.[4] ..... B27C 7/10; B27G 13/00

[52] U.S. Cl. ..... 144/241; 144/176; 241/92; 241/298; 407/48

[58] Field of Search ..... 407/32, 31, 41, 49, 407/52, 33, 43, 51, 48, 61, 99, 102; 241/92, 298; 144/117 R, 162 R, 176, 218, 230, 241

[56] References Cited

U.S. PATENT DOCUMENTS

| | | | |
|---|---|---|---|
| 3,542,302 | 11/1970 | Salzmann, Jr. . | |
| 3,785,417 | 1/1974 | Vora . | |
| 3,981,337 | 9/1976 | Sundstrom . | |
| 4,047,670 | 9/1977 | Svensson . | |
| 4,194,545 | 3/1980 | Kostermeier | 144/230 |
| 4,349,057 | 9/1982 | Bachmann et al. | 144/230 |
| 4,487,240 | 12/1984 | Bergler | 407/48 |
| 4,503,893 | 3/1985 | Demopoulos . | |
| 4,506,711 | 3/1985 | Armbruster et al. | 144/230 |
| 4,545,413 | 10/1985 | Sundberg et al. | 241/298 |
| 4,557,305 | 12/1985 | Berger et al. | 144/241 |
| 4,669,516 | 6/1987 | Carpenter et al. | 144/241 |

OTHER PUBLICATIONS 1 p. of Drawings of Admitted Prior Art of a Reversible Knife.

*Primary Examiner*—W. Donald Bray
*Attorney, Agent, or Firm*—Kolisch, Hartwell & Dickinson

[57] ABSTRACT

Chipper apparatus including a rotating disc with one or more knives mounted on the disc operable to produce wood chips under the cutting action of the knives. Each knife comprises an elongate knife body bounded by opposed cutting edges. The knife includes a back side formed back knife surfaces extending inwardly on the knife from its cutting edges and the back knife surfaces meeting with a bearing surface. The front side of the knife includes front knife surfaces extending inwardly on the knife from its cutting edges joining with an elongated key-receiving channel indented inwardly into the knife body. A knife is mounted on a rotatable chipper disc through a clamp member which bears against the bearing surface of a knife and a counter-knife which supports the front side of the knife and which includes an elongate key portion fitting within the key-receiving channel of the knife.

4 Claims, 2 Drawing Sheets

CHIPPER KNIFE

This application is a division of prior filed application entitled "Chipper Disc and Knife Assembly", Ser. No. 07/066,864, filed June 24, 1987, now U.S. Pat. No. 4,771,718, issued Sept. 20, 1988.

BACKGROUND AND SUMMARY OF THE INVENTION

This invention relates to chipper apparatus, and more particularly, to chipper apparatus which includes a rotating chipper disc and one or more knives mounted on this disc operable to produce wood chips on the feeding of wood material against the disc. The invention more specifically is directed to a novel construction for a double-edged chipper knife usable in such apparatus.

In recent years, so-called double-edged chipper knives have become increasingly popular, since through turning of the knife a convenient way is provided for replacing the cutting edge which is used in the chipper without having to grind an edge. Furthermore, such knives lend themselves to use in a returnable system, wherein after dulling of both edges, they are returned or thrown away with the elimination of any grinding by the user.

While the advantages of double-edged knives are recognized, certain problems have been experienced with knife constructions known to date. Certain knives, for instance, have a geometry which is somewhat complex, introducing problems in making the knife and in properly mounting it on the chipper disc. A problem of general concern is that with many knife constructions, and during use, wood particles, resins, etc. tend to build up between the knife and the structure mounting it, causing displacement of the knife in its mounting and overheating of the knife. Furthermore, any system which relies upon clamping onto certain blade surfaces in a knife introduces a problem, in that should it be desired to change the angle of these blade surfaces, such also requires a change in the clamping structure which is used to clamp onto the knife in the chipper. Another problem which has been encountered is the tendency for a knife, when such twists in its mounting during use, to bend or break the mounting structure which clamps it in place on the chipper.

A general object of this invention is to provide an improved double-edged knife for a chipper with a construction taking care of many of the difficulties discussed above.

A more specific object is to provide a double-edged chipper knife which lends itself to being securely mounted in a chipper disc, but nevertheless, is devoid of the complex geometry characterizing certain prior art knives.

Another object is to provide a double-edged chipper knife which has a back side in part surfaced by blade surfaces, and in part surfaced by a bearing surface which is the surface utilized in clamping the knife in place. With the construction contemplated, any changes in the angles of the blade surface do not affect the placement or inclination of the bearing surface.

A further feature and object of the invention is a knife which features an elongate key-receiving channel on one of its sides relied upon to anchor the knife in place on the chipper disc, and organized in such a manner as to inhibit build up of wood residues between the knife and the structure mounting it.

The double-edged knife of this invention may be constructed to have a relatively small edge-to-edge cross sectional dimensional, with the knife, nevertheless, being properly supportable in the chipper with the knife held from fluttering (which affects the uniformity of the chips produced and results in premature dulling of the knife), and with the knife supported in such a manner as not to affect its pull angle into the wood. The knife, furthermore, may be firmly held in a manner inhibiting twisting of the knife in its mounting and with forces generated in the knife during cutting properly restrained.

BRIEF DESCRIPTION OF THE DRAWINGS

These and other objects and advantages are attained by the invention, which is described hereinbelow in conjunction with the accompanying drawings, wherein.

DETAILED DESCRIPTION OF A PREFERRED EMBODIMENT

Figure 1:
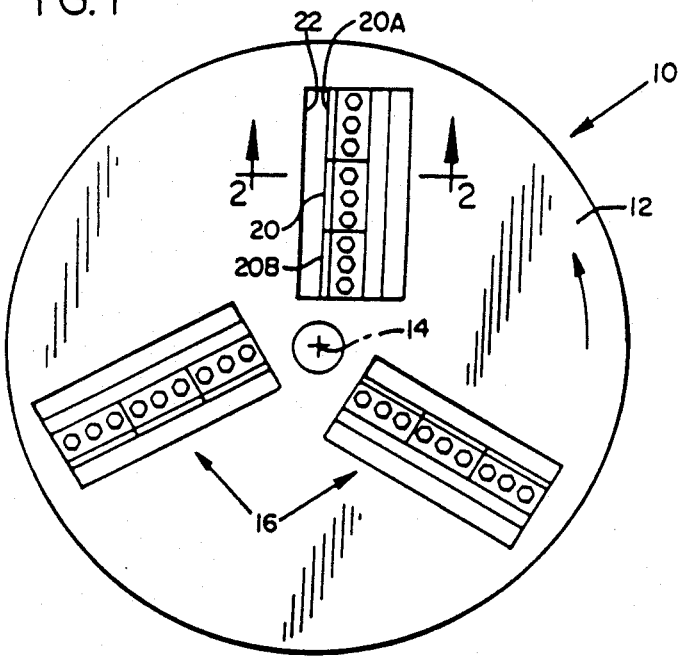
FIG. 1 is a view looking at the front of a chipper disc and illustrating knives and a mounting for these knives supporting the knives on the disc.

Referring now to the drawings, illustrated in FIG. 1 at 10 is a chipper disc which is substantially circular in outline, has a substantially flat disc surface 12 forming the face of the disc, and which is mounted in the chipper apparatus for powered rotation about its axis 14. Arranged with such extending generally radially on the chipper disc are multiple knife assemblies designated generally at 16. Although three such assemblies are shown, it should be obvious that the number and relative spacing of these knife assemblies are subject to variation with different sizes and types of chipper apparatus.

Each of the knife assemblies 16 is illustrated as having three knives disposed end to end and indicated at 20, 20A, and 20B, such being aligned with each other in the assembly. Again, it should be understood that the number of knives in a knife assembly will vary according to the individual installation.

During use, the chipper disc is rotated in the direction shown by the arrow in FIG. 1, or in a counter clockwise direction, which is the direction of travel of the disc. Immediately in advance of the knives in a knife assembly is an opening 22 provided in the disc. During operation of the chipper and with the advancing of a log or other wood against the chipper disc, the knives in a knife assembly shave wood chips from the wood, with such then traveling through an opening 22 to be expelled from the chipper.

Figure 3:
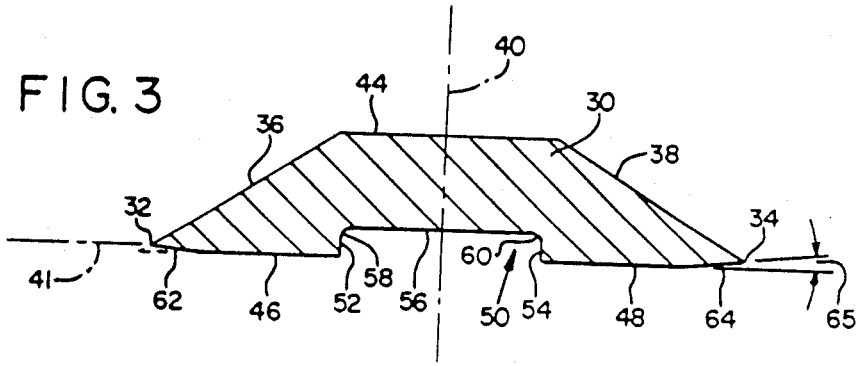
FIG. 3 is a cross-sectional view of a double-edged knife as contemplated, on an even larger scale.

Considering now in more detail the construction of a knife, and referring to FIG. 3 which illustrates the knife in cross section, such includes a knife body 30 bounded along opposite margins by elongate cutting edges indicated at 32 and 34. That part of the knife which appears at the top of FIG. 3 is referred to as the back side of the knife, and the opposite side or the side adjacent the bottom of FIG. 3, the front side of the knife.

The back side of the knife is defined by a pair of back knife surfaces 36, 38 extending inwardly on the knife body from respective cutting edges. These may have substantially equal widths and ordinarily are planar and are inclined at a common acute angle with respect to a plane, indicated at 40, which bisects the knife body and extends normal to the plane 41 defined by cutting edges 32, 34. In the particular embodiment of the invention illustrated, this angle is around 35 degrees, although the angle will vary depending on the chipper and the type of chips desired. Extending between and joining with these back knife surfaces is what is referred to as a bearing surface 44, which may be planar and ordinarily parallel to the plane of the two cutting edges. With the knife being symmetrical when viewed in a transverse cross section, plane 40 described bisects bearing surface 44.

The opposite or front side of the knife is defined by a pair of so-called front knife surfaces 46, 48, which in the embodiment of the invention shown are flat and occupy a common plane paralleling plane 41. Between these front knife surfaces and extending the length of the knife body is a key-receiving channel 50. Such is defined by side edges 52, 54 disposed normal to the plane of the knife edges, a floor 56 which generally parallels the plane of the knife edges, and preferably, rounds 58, 60 providing a smooth continuation between the side edges of the channel and its floor 56. With the knife body having symmetry in cross section, knife surfaces 46, 48 have equal width and key-receiving channel 50 is bisected by plane 40 earlier described.

In a preferred embodiment of the invention, each knife surface 46, 48 is relief ground along the outer margin thereof which meets with a cutting edge. Thus, the knife surfaces include relief surface portions shown in FIG. 3 at 62 and 64. The remaining surface portions of the two knife surfaces are flat, and preferably extend in a common plane, these remaining surface portions forming a major portion, normally 70% or more, of each knife surface. This plane, with surfaces 36, 38 inclined at 35 degrees relative to bisecting plane 40, inclines at an acute angle, i.e, 35 degrees, relative to surfaces 36, 38. A relief surface portion inclines inwardly on the knife body in a direction extending toward a cutting edge and relative to the plane of the major portion of the knife surface at a slight acute angle, typically, ranging from four to seven degrees (shown at 65 in FIG. 2). Thus, while a knife surface is essentially planar in a preferred embodiment, it is not entirely so, by reason of the slight inclination of a relief surface portion.

Figure 2:
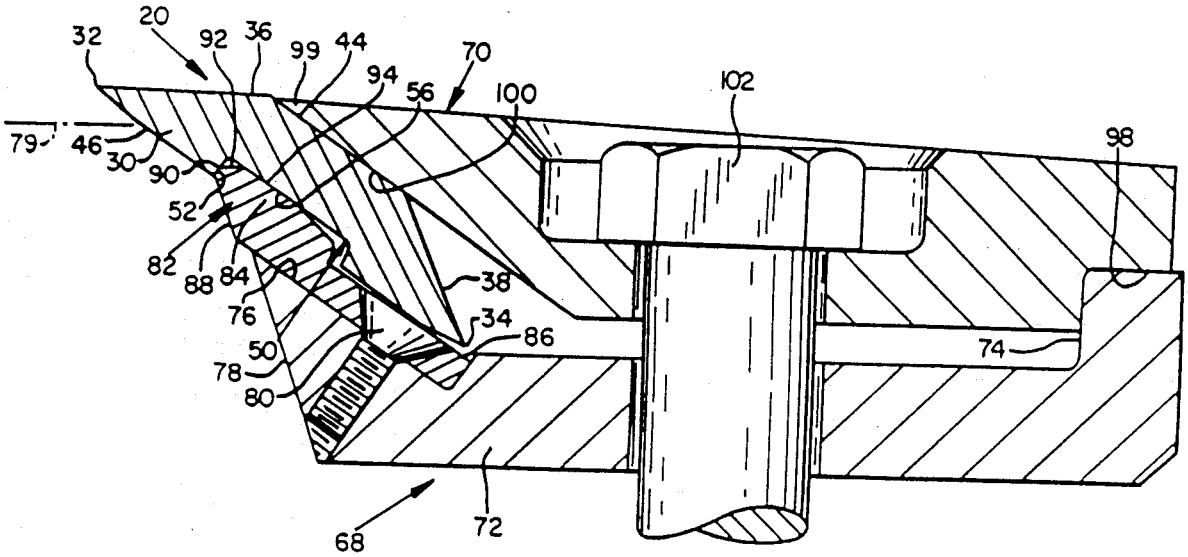
FIG. 2 is an enlarged cross-sectional view, taken generally along the line 2—2 in FIG. 1, and showing further details of a knife as contemplated and its mounting on the chipper disc.

A knife of the type described is mounted in a knife assembly utilizing the mounting structure shown in FIG. 2. Specifically, this structure includes what is referred to as a base 68 and a clamp 70, these supporting a knife with the knife clamped therebetween.

Further describing the base, such includes a holder 72 provided along one edge with a ridge 74. The opposite edge of the holder is formed with an inclined shelf 76 and surfaced, where such faces the direction of travel of the knife assembly (which is to the left in FIG. 2), with a surface 78 which is inclined with respect to the plane of the disc surface which includes the knife assembly (shown at 79 in FIG. 2).

Detachably mounted on the holder as by screws 80 is a counter-knife or key element 82. Such extends the length of the knife and sits within shelf 76 of the holder. Formed along the forward margins of the counter-knife, which is the upper margin as illustrated in FIG. 3, is an elongate key portion 84, and downwardly and to the right from this key portion a support surface 86. The key portion projects from the side of the counter-knife which faces the knife. Counter-knife 82 further includes an inclined wear or fender surface 88 extending along the underside thereof at its forward margin. Bounding the forward margin of key portion 84 is a forward edge or surface 90, and this edge joins with fender surface 88. Edge surface 90 joins through a round 92 with a surface 94.

Clamp 70 extends along the length of the knife above the knife. Such is notched along one edge by notch 98 which fits over ridge 74 of the holder. Along the underside of the clamp adjacent its opposite edge or toe 99 is a flat expanse referred to as a clamping surface 100. The clamp and holder are secured together and to the chipper disc by fasteners such as the one shown at 102. Reference may be had to U.S. Pat. No. 4,669,516 for further details of the mounting of such an assembly on a chipper disc.

With a knife mounted in place on a chipper disc utilizing the holder, counter-knife, and clamp illustrated in FIG. 2, the knife becomes positioned with one of its cutting edges (edge 32 in FIG. 2) positioned beyond the plane 79 of the cutter disc, and with this cutting edge and adjacent portions of the knife protruding over an opening 22 in the chipper disc. The knife is positioned with its front side facing the direction of travel of the disc, and with the plane of its front knife surface inclined at an acute angle with respect to the plane of the disc surface where such extends rearwardly from the cutting edge, or put in another way, where the plane recedes from the cutting edge. The knife is firmly clamped in position, with clamping surface 100 of the clamp clamped firmly against bearing surface 44 of the knife. Key portion 84 of the counter-knife seats within channel 50 provided on the front side of the knife. Edge surface 90 of the key portion bears against side edge 52 of channel 50. A forward portion of surface 94 of the key portion bears against a forward portion of floor 56 in the knife. The knife is additionally supported while in its clamped position with surface 86 bearing against the relief surface in the knife which is adjacent the cutting edge of the knife opposite edge 32, i.e., edge 34 in FIG. 2.

As so positioned, the knife is firmly held from twisting on itself, and forces tending to break or bend the clamp where such bears against the bearing surface of the knife are minimized. This is because when the exposed cutting edge of the knife meets resistance tending to cause it to twist in its mounting, such forces are resisted by toe 99 and adjacent surface portions of the clamp spaced a substantial distance from where the knife is supported adjacent its edge 34. Put in another way, the operative moment arm for the forces exerted on the protruding cutting edge in the knife is nearly the same as the operative moment arm for forces resisting turning, a feature not present in many prior art constructions.

It should also be noted that the knife surfaces on the back side of the knife are not used in clamping the knife in place. This means that the inclination of these back surfaces may be changed as desired to fit the particular operating conditions under which the chipper disc is used without affecting how the knife is held in place.

It should be further noted, and since edges 52, 54 defining channel 50 are normal or substantially normal to front knife surfaces 46, 48, there is minimal tendency for debris to work between the counter-knife and knife. The front side of the knife which extends from forward edge 32 inclines at an acute angle relative to the plane of the disc surface in a direction receding from this edge and meets wear surface 88 in the counter-knife. This wear surface of the counter-knife also inclines at an acute angle relative to the plane of the disc surface in a direction receding from edge 32, this acute angle being somewhat greater than the first-mentioned acute angle. Thus, material cut by the knife with operation of the chipper moves down along a front knife surface, i.e., surface 46 in FIG. 3, thence to travel over surface 88 of the counter-knife until finally deflected out of the chipper disc assembly. Material, if such is to work between the counter-knife and knife, must travel at substantially a right-angle path on leaving front knife surface 46.

Figure 4:
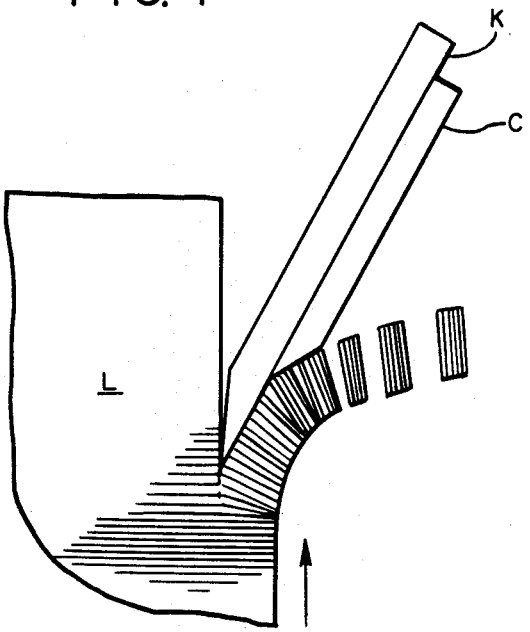
FIG. 4 is a schematic illustration of a knife mounting which tends to produce overly thick chips.
Figure 5:
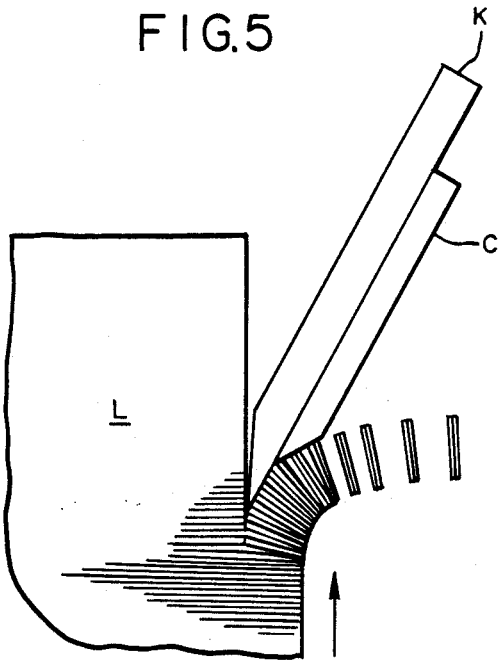
FIG. 5 is a schematic illustration of a mounting tending to produce overly thin chips.

As illustrated in FIG. 4 in conjunction with a conventional knife "K" and counter-knife "C", cut material, on traveling from leg "L" along the front side of the knife and thence against the leading surface of the counter-knife, is deflected by the counter-knife surface away from the knife proper with material breaking apart and the formation of chips. In FIG. 4, the counter-knife is too far back from the leading edge of the chipper knife, which tends to result in chips being produced having greater thickness than desired. A converse situation is illustrated in FIG. 5 where the counter-knife "C"is positioned in a relatively extended position on the chipper knife and with this positioning, chips tend to form which are too thin. This discussion emphasizes the importance of the position of the counter-knife and its leading surface with respect to the chipper knife. With the usual woods processed in America, and to obtain desired chip size, the width of the exposed front side of the chipper knife might range from 0.4 to 0.6", which with the chipper knife of the invention translates to a front knife surface having a width of this dimension (with the knife mounted, surface 88 of the counter-knife becomes located where the front knife surface terminates by reason of joining with a side edge of the key-retaining channel).

Referring to FIG. 2, cutting edge 32 of the chipper knife is the one that is performing the cutting, and front knife surface 46 the surface fending chips away after being cut.

Figure 6:
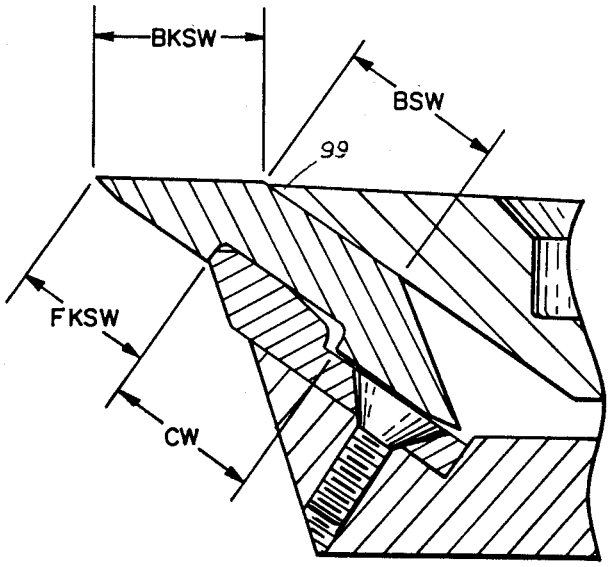
FIG. 6 is a view, similar to portions of FIG. 2, but having various dimensions indicated therein.

With surfaces 36, 46 in a specific embodiment defining an angle of 35 degrees as earlier described (this angle usually is within the range of 30 to 40 degrees), and with the knife constructed so that surface 88 of the counter-knife appears directly at the termination of the front knife surface, the back knife surface normally will have a width at least as great as the width of the front knife surface. In FIG. 6, the width of the front knife surfaces is indicated at FKSW and the width of a back knife surface at BKSW, and it will be noted that the width BKSW slightly exceeds the width FKSW.

With the knife deriving a good deal of its support from adjacent the edge which is not serving as the cutting edge, and with it desirable, as earlier explained, that this portion of the knife be well back of toe 99, the width of the key-retaining channel shown at CW in FIG. 6 will approximate closely the width of a front knife surface FKSW. More broadly stated, the width of the key-retaining channel should preferably be 50 percent or more of the width of the front knife surface.

In FIG. 6, the width of the bearing surface in the knife is indicated at BSW. This bearing surface width in the embodiment illustrated approximates the width of a back knife surface, i.e., the width BKSW, and thus only slightly exceeds the width of the key-retaining channel or CW. In this way, the knife is held from fluttering, as would be the case if the bearing surface width was minimal, and the knife were supported on its back side well rearwardly of where supported on its front or underside. The support of the bearing surface does not extend well beyond where the knife is supported on its underside by the key in the counter-knife, since with this type of support and with the knife mounted in place, it would tend to turn in its mounting, affecting the pitch angle of the knife and the ability of the knife (the angle defined by surface 36 and plane 79 in FIG. 2 and typically about 2 degrees) to pull into the wood during the cutting operation. More broadly stated, optimally the bearing surface width is within the range of 50 to 150 percent of the width of a front knife surface in the knife.

During operation of the chipper, any wear which occurs on material moving past the exposed blade surface of the knife and thence over the counter-knife occurs for the most part in surface 88 of the counter-knife. If wear becomes excessive in this area, it is a relatively easy matter to replace the counter-knife to provide a new wear surface.

When one of the edges in a knife becomes dull through usage, the clamp mounting for the knife may be loosened and the knife removed. If the knife is then turned end-for-end and then remounted in the clamp mounting, this places its opposite edge in a cutting position. In its newly mounted position, the front side of the knife still faces forwardly and the back side rearwardly.

A knife configured as herein disclosed may be constructed which operates very efficiently and effectively in producing the chips desired, but which has a relatively small edge-to-edge dimension. For instance, a commercial embodiment of the knife has been constructed configured as illustrated which has a total width edge-to-edge of approximately 1½". This is particularly advantageous in a so-called throw-away system, where the knives after dulling of both edges are scrapped, as it tends to minimize the initial cost of the knife, making such handling cost-effective. A knife having a width of 3" or 4" might perform in a proper manner, but the amount of material required to make such a knife would make the knife impractical in a truly throw-away system.

While there has been described herein a specific embodiment of the invention, obviously variations and modifications are possible without departing from the invention.

It is claimed and desired to be secured by Letters Patent:

1. In a chipper knife which includes an elongate knife body bounded on opposite margins by elongate cutting edges lying in a plane and said knife body having a back side and a front side extending between said knife edges, a pair of back knife surfaces extending inwardly on the knife body from respective cutting edges and a bearing surface extending between said back knife surfaces forming said back side of the knife, the back knife surfaces being inclined at a common acute angle with respect to a plane bisecting the knife disposed normal to the plane of the cutting edges, a pair of front knife surfaces extending inwardly on the knife from respective cutting edges forming the front side of the knife disposed at a common acute angle with respect to respective back knife surfaces, the front knife surfaces joining with an elongate key-retaining channel indented inwardly into the knife body and extending longitudinally of the knife body intermediate said knife edges, said back knife surfaces having substantially equal widths and said front surfaces having substantially equal widths and the width of a back knife surface being at least as great as the width of a front knife surface, the widths of the front knife surfaces approximately equaling the width of the channel, and the width of the bearing surface approximately equaling the width of a back knife surface.

2. The chipper knife of claim 1, wherein each front knife surface includes a relief surface portion joining with a cutting edge and a remaining surface portion forming the majority of the front knife surface joining with the relief surface portion, the relief surface portion of a knife surface inclining inwardly on the knife body progressing toward a knife edge at a slight acute angle relative to the remaining surface portion of the knife surface.

3. A chipper knife including an elongate knife body bounded on opposite margins by elongate cutting edges lying in a plane and having a back side extending between the cutting edges and a front side extending between the cutting edges, said back side being formed by a pair of back knife surfaces extending inwardly on the knife body from respective cutting edges and inclined at a common acute angle with respect to a plane bisecting the knife disposed normal to the plane of the cutting edges and further being formed by a bearing surface which extends between and joins said back knife surfaces, the front side of the knife being formed by a pair of front knife surfaces extending inwardly on the knife from respective cutting edges at a common acute angle with respect to respective back knife surfaces and further being formed by an elongate key-retaining channel indented inwardly into the knife body and extending longitudinally of the knife body intermediate the knife edges, the back knife surfaces having substantially equal widths and the front knife surfaces having substantially equal widths, the width of said key-retaining channel approximately equaling the width of a front knife surface and the width of said bearing surface approximately equaling the width of a back knife surface.

4. The chipper knife of claim 3, wherein a front knife surface includes a relief surface portion joining with a cutting edge and a remaining surface portion forming the majority of the front knife surface joining with the relief surface portion, the remaining surface portions of the front knife surfaces occupying a common plane and the relief surface portion of the front knife surface inclining inwardly on the knife body at a slight angle from said plane progressing in a direction toward a knife edge.

* * * * *